US006467876B1

(12) United States Patent
Karasawa et al.

(10) Patent No.: US 6,467,876 B1
(45) Date of Patent: Oct. 22, 2002

(54) POROUS STRUCTURE, INK-JET RECORDING HEAD, METHODS OF THEIR PRODUCTION, AND INK JET RECORDER

(75) Inventors: Yasushi Karasawa; Mitsuro Atobe, both of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/307,992

(22) Filed: May 10, 1999

Related U.S. Application Data

(63) Continuation-in-part of application No. PCT/JP98/04034, filed on Sep. 9, 1998.

(30) Foreign Application Priority Data

Sep. 10, 1997 (JP) ..... 9-245121
Jun. 18, 1998 (JP) ..... 10-170952

(51) Int. Cl.[7] ..... B41J 2/135
(52) U.S. Cl. ..... 347/45
(58) Field of Search ..... 347/45, 47

(56) References Cited

U.S. PATENT DOCUMENTS 5,674,625 A * 10/1997 Takahashi et al. ..... 428/428
5,693,236 A * 12/1997 Okumura et al. ..... 216/7
5,759,421 A * 6/1998 Takemoto et al. ..... 216/27
5,790,151 A * 8/1998 Mills ..... 347/47
6,210,750 B1 * 4/2001 Cho et al. ..... 427/190

FOREIGN PATENT DOCUMENTS

JP 06093121 4/1994
JP 10130844 5/1998
JP 10156282 6/1998
JP 410203819 * 8/1998

OTHER PUBLICATIONS

*Introduction to Fluorochemistry* The Nikkan Kogyo Shinbun Ltd., publsihed Mar. 1, 1997, From line 10 of p. 59 to line 6 of p. 63 and English translation thereof.
Patent Abstracts of Japan of JP 10–130,844 of May 1998.
Patent Abstracts of Japan of JP 06093121 of Apr. 1994.
Patent Abstracts of Japan of JP 10156282 of Jun. 1998.

* cited by examiner

*Primary Examiner*—John Barlow
*Assistant Examiner*—Michael S. Brooke
(74) *Attorney, Agent, or Firm*—Ladas & Parry

(57) ABSTRACT

A porous structure in which water repellency can be kept for a long term; an ink-jet recording head in which the nozzle surface is superior in water repellency properties, and high printing quality can be maintained for a long term; a method manufacturing such a porous structure and such an ink-jet recording head; and an ink-jet recording apparatus provided with such an ink-jet recording head. In a porous structure (100), recess portions (17) and protrusion portions (18) are formed on the surface of a substrate of the porous structure. The height of the protrusion portions (18) on the surface oft he substrate is uniform. In addition, the recess portions (17) and the protrusion portions (18) are formed to have such a size that a liquid drop (21) does not fall down into the recess portion (17), and can contact with an air layer (20) in the recess portion (17). The porous structure (100) is adopted in the ink ejecting surface except for ink ejecting holes in an ink-jet recording head. The ink-jet recording head is mounted on an ink-jet recording apparatus.

11 Claims, 10 Drawing Sheets

(a)
23
11
24
(b)
22
23
11
(c)
25
23
11
26
(d)
27
23
11
26
(e)
17
18
11
(f)
19
17
18
2
11

(a)
312
311
(b)
312
(c)
315
312
311
(d)
311
(e)
18
17
19
2
311

POROUS STRUCTURE, INK-JET RECORDING HEAD, METHODS OF THEIR PRODUCTION, AND INK JET RECORDER

This application is a continuation in part of PCT/JP 98/04034, filed Sep. 9, 1998.

TECHNICAL FIELD

The present invention relates to a porous structure superior in water repellency, an ink-jet recording head, a method of manufacturing those, and an ink-jet recording apparatus.

BACKGROUND ART

Water repellency treatment is performed for preventing drop adhesion or for preventing contamination. Various water repellents and water repellency treatments have been developed and used in various products including electronic equipment. Particularly, in an ink-jet recording apparatus, water repellency treatment has been put to practical use as surface treatment of a head which is the heart of the ink-jet recording apparatus. The water repellency treatment is an important treatment influencing printing quality.

Glass, metal, etc. is used as a constituent material component of an ink ejecting surface of an ink-jet recording head. When water-based or oil ink is used in an ink-jet recording head, drops of the ink are apt to adhere to a nozzle surface under the conditions that the water repellency of the nozzle surface is not sufficient. As a result, straight shooting of ejected ink drops is hindered to cause a trouble such as printing turbulence or the like to thereby occasionally affect long-term reliability. In addition, the constituent material of the ink ejecting surface of the ink-jet recording head is characteristically apt to get wet with ink. Therefore, water repellency treatment is given to the ink ejecting surface in order to perfectly prevent water based or oil ink from adhesion.

As for such water repellency treatment, there is a water repellency treatment (super-water-repellency treatment) ideal for an ink-jet recording head, in which the contact angle of water exceeds 120 degrees. As mentioned in "Introduction to Fluorochemistry", THE NIKKAN KOGYO SHINBUN LTD., published Mar. 1, 1997, from line 10 of p.59 to line 6 of p.63, known is an eutectoid plating method in which polyfluoroethylene particles increased in fluorine atom density are dispersed in nickel film, or a coating method in which such a surface shape as trade name "Kanpenirex" by KANSAI PAINT CO., LTD. is designed to realize super-water-repellency.

However, conventional super-water-repellency treatment methods have problems as follows.

(1) Various surface active agents are added to ink for an ink-jet recording apparatus in order to make pigment disperse stably and permeate paper. In the eutectoid plating method, these surface active agents are absorbed into the nickel surface, so that the quality of the nickel surface may be lowered by ink wetting in long-term printing.

(2) In an ink-jet recording apparatus, a rubbing operation with rubber is required for cleaning paper powder or foreign contamination adhering to the head surface. In the conventional super-water-repellency coating methods, coating may peel off through this operation, so that the quality of the head surface may be lowered.

DISCLOSURE OF THE INVENTION

The present invention has been made to solve the foregoing problems. It is an object of the present invention to provide a porous structure in which water repellency is kept for a long term; an ink-jet recording head with a nozzle surface superior in water repellency properties to maintain high printing quality over a long term; a method of manufacturing such a porous structure and such an ink-jet recording head; and an ink-jet recording apparatus equipped with such an ink-jet recording head.

(1) The porous structure according to the present invention consists of desired protrusion portions and recess portions formed on a surface of a substrate, heights of the protrusion portions on the surface being made uniform. Incidentally, a height of a protrusion portion formed on a substrate is defined as a level of the top surface of the protrusion portion in the direction of thickness of the substrate, in this invention.

(2) In the porous structure according to the above paragraph (1), differences in heights of the protrusion portions are within 250 $\mu$m.

(3) In the porous structure according to the above paragraph (1), differences in heights of the protrusion portions are within 15 $\mu$m.

(4) In the porous structure according to the above paragraph (1), differences in heights of the protrusion portions are within 5 $\mu$m.

(5) The porous structure according to the present invention consists of desired protrusion portions and recess portions formed on a surface of a substrate, a depth of the recess portions on the surface being not smaller than a predetermined value.

(6) In the porous structure according to the above paragraph (5), the depth of the recess portions is not smaller than 1 $\mu$m.

(7) In the porous structure according to the above paragraph (5), the depth of the recess portions is not smaller than 3 $\mu$m.

(8) In the porous structure according to the above paragraph (5), the depth of the recess portions is not smaller than 5 $\mu$m.

(9) The porous structure according to the present invention consists of desired protrusion portions and recess portions formed on a surface of a substrate, and has such a size that liquid drops do not fall down into the recess portions, and the liquid drops can surely contact with an air layer in the recess portions.

(10) In the porous structure according to the above paragraph (9), widths of the protrusion portions or the recess portions is between 0.2 $\mu$m and 500 $\mu$m.

(11) In the porous structure according to the above paragraph (9), widths of the protrusion portions or the recess portions is between 0.5 $\mu$m and 30 $\mu$m.

(12) In the porous structure according to the above paragraph (9), widths of the protrusion portions or the recess portions is between 1 $\mu$m and 10 $\mu$m.

(13) In the porous structure according to the above paragraph (1), (5) or (9), a water repellant film is formed on the substrate having the protrusion portions and recess portions.

(14) In the porous structure according to the above paragraph (1), (5) or (9), the protrusion and recess portions comprises protrusion portions which are disposed distributively or in the form of stripes or a lattice.

(15) In the porous structure according to the above paragraph (1), (5) or (9), the substrate is of silicon, silicon oxide, or glass.

(16) The ink-jet recording head according to the present invention has water repellency performance given to an ink ejecting surface, wherein the ink ejecting surface except ink ejecting holes is constituted by the porous structure defined in the above paragraphs (1), (5) or (9).

(17) The ink-jet recording head according to the present invention has water repellency performance given to an ink ejecting surface, wherein the ink ejecting surface except ink ejecting holes is constituted by the porous structure defined in the above paragraph (9).

(18) In the method of manufacturing a porous structure according to the present invention, the porous structure defined in the above paragraphs (1), (5) or (9) is manufactured by a photolithography method and an etching method.

(19) In the method of manufacturing a porous structure according to the above paragraph (18), the etching method is a trench dry etching.

(20) In the method of manufacturing a porous structure according to the above paragraph (18), the etching method is an anode electrolysis method.

(21) In the method of manufacturing a porous structure according to the above paragraph (18), the etching method is an isotropic wet etching method.

(22) In the method of manufacturing a porous structure according to the above paragraph (18), the etching method is an anisotropic wet etching method.

(23) In the method of manufacturing a porous structure according to the above paragraph (18), the etching method is an isotropic dry etching method.

(24) In the method of manufacturing an ink-jet recording head according to the present invention, the porous structure defined in the above paragraph (16) is manufactured by a photolithography method and an etching method.

(25) In the method of manufacturing an ink-jet recording head according to the above paragraph (24), the etching method is a trench dry etching method.

(26) In the method of manufacturing an ink-jet recording head according to the above paragraph (24), the etching method is an anode electrosis method.

(27) In the method of manufacturing an ink-jet recording head according to the above paragraph (24), the etching method is an isotropic wet etching method.

(28) In the method of manufacturing an ink-jet recording head according to the above paragraph (24), the etching method is an anisotropic wet etching method.

(29) In the method of manufacturing an ink-jet recording head according to the above paragraph (24), the etching method is an isotropic dry etching method.

(30) The ink-jet recording apparatus according to the present invention has such an ink-jet recording head as defined in the above paragraph (16).

(31) The ink-jet recording apparatus according to the present invention has such an ink-jet recording head as defined in the above paragraph (17).

As described above, according to the present invention, a function of water repellency is obtained by a porous structure having a shape of protrusion-and-recess formed artificially on a surface of a substrate. Accordingly, superior properties of water repellency can be kept for a long term.

In addition, according to the present invention, an ink ejecting surface of an ink-jet recording head expect for ink ejecting holes is made to be such a porous structure. Accordingly, the water repellency performance to ink is improved. As a result, printing quality is superior for a long term.

Incidentally, water repellency performance in the present invention includes oil repellant performance.

Further, according to the present invention, the porous structure is manufactured by a photolithography method and an etching method. Accordingly, it is possible to manufacture a super-water-repellency structure having reproducibility.

THE BEST MODE FOR CARRYING-OUT THE INVENTION

Embodiment 1

Figure 1:
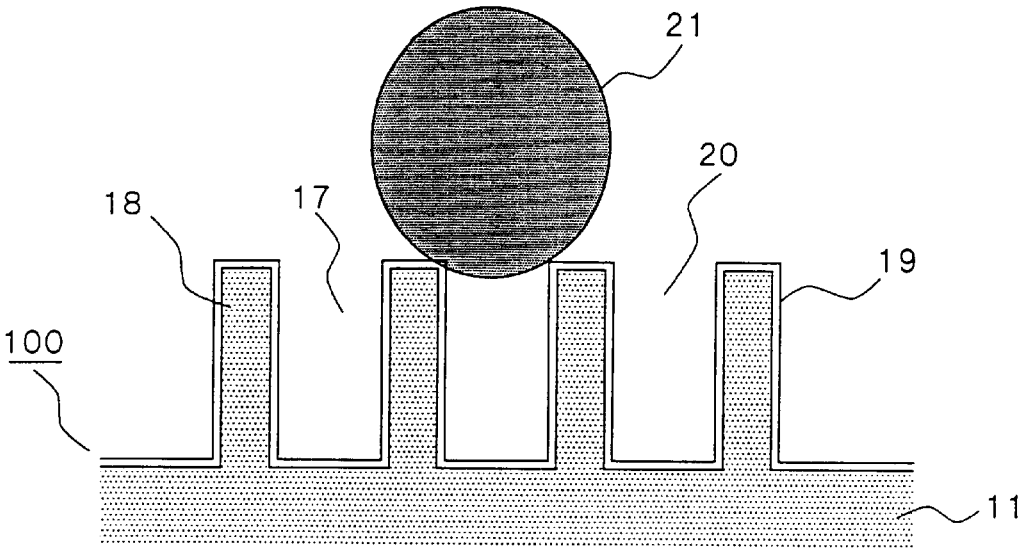
FIG. 1 is an explanatory view of a porous structure according to Embodiment 1 of the present invention.

FIG. 1 is an explanatory view of a porous structure according to Embodiment 1 of the present invention. In FIG. 1, in a porous structure 100, recess portions 17 and protrusion portions 18 are formed on a surface of a silicon substrate 11, and a water repellant film 19 is formed on this surface. In addition, an air layer 20 is produced in the recess portions 17 formed on the surface of the silicon substrate 11.

Figure 2:
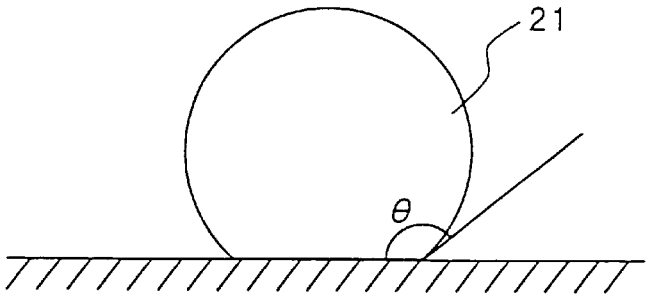
FIG. 2 is an explanatory view of the contact angle of water when a function of water repellency is exhibited.

FIG. 2 is an explanatory view of the contact angle of water when the water repellency function is exhibited. As shown in FIG. 2, it is necessary that the contact angle θ of water is not smaller than 120 degrees (in the case of ink drops, not smaller than 90 degrees) in order to exhibit the water repellency function. In the porous structure 100 in FIG. 1, in order to exhibit the water repellency function with the contact angle θ of water not smaller than 120 degrees, it is necessary that a recess portion 17 has such a size that a liquid drop 21 can contact with the air layer 20 without falling down into the recess portion 17.

Figure 3:
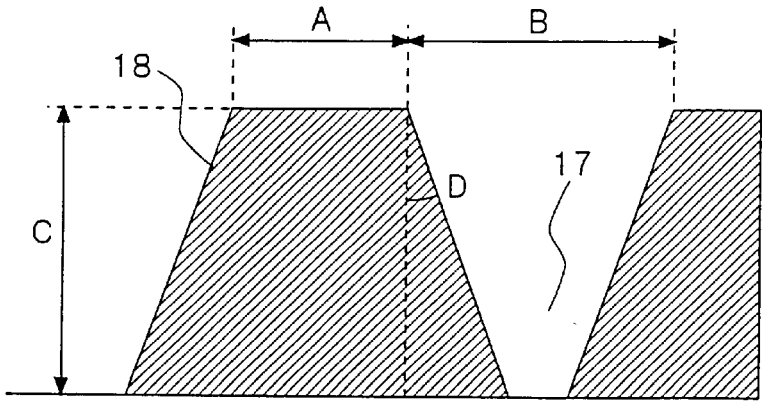
FIG. 3 is an explanatory view about the size of recess portions and protrusion portions in FIG. 1.

FIG. 3 is an explanatory view about size of a recess portion 17 and a protrusion portion 18 in FIG. 1. In FIG. 3, A designates protrusion width (based on mask design); B, recess width (based on mask design); C, a working amount (depth based on etching time); and D, a side wall angle (based on etching conditions). When this porous structure is applied to an ink-jet recording head, the above-mentioned values A and B are restricted of themselves based on the relation to the diameter of an ink drop which is about 10 $\mu$m.

Figure 4A:
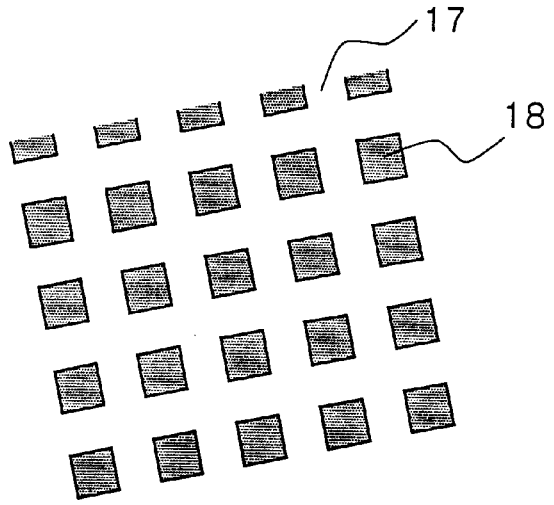
FIGS. 4A, 4B and 4C are plan views showing examples of a porous structure 100 in FIG. 1.
Figure 4B:
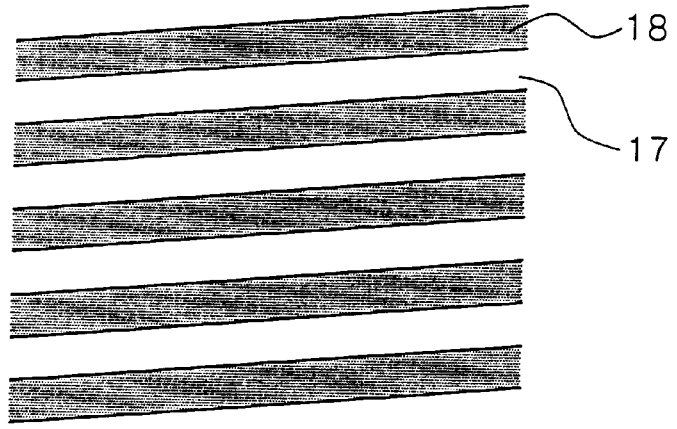
Figure 4C:
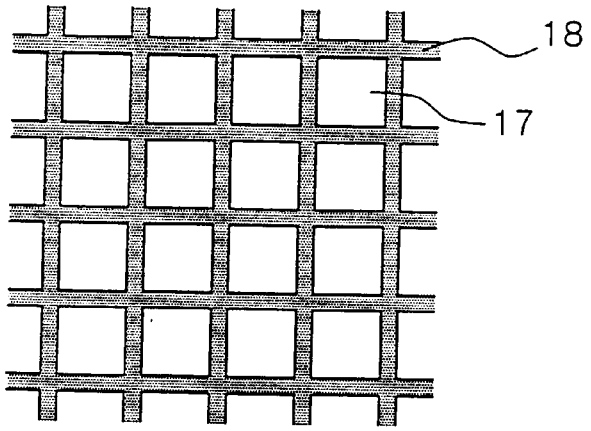

As for the value C, a certain measure of depth is necessary to prevent a phenomenon that an ink drop is enclosed in a state in contact with the bottom surface. Therefore, the values A and B are defined within a range from 0.2 to 500 μm, preferably from 0.5 to 30 μm, more preferably from 1 to 10 m. In addition, the above-mentioned value C is defined to be a depth not smaller than 1 μm, preferably, not smaller than 3 μm, more preferably, not smaller than 5 μm. Further, differences of heights of the protrusion portions defined as levels of the top surfaces of the protrusion portions in the direction of thickness of the substrate are quantatively defined to be not larger than 250 μm or 15 μm for example, preferably not larger than 5 μm in view of scratch-proof FIGS. 4A, 4B and 4C are plan views showing examples of the porous structure 100 in FIG. 1. FIG. 4A shows an example where the protrusion portions 18 are arranged and distributed regularly; FIG. 4B shows an example where the protrusion portions 18 are arranged in lines; and FIG. 4C shows an example where the protrusion portions 18 are arranged in a lattice. Although FIG. 4A shows an example where the protrusion portions 18 are square poles, they may be other various poles such as triangle ones, pentagonal ones, hexagonal ones, circular ones, etc.

Embodiment 2

Figure 5:
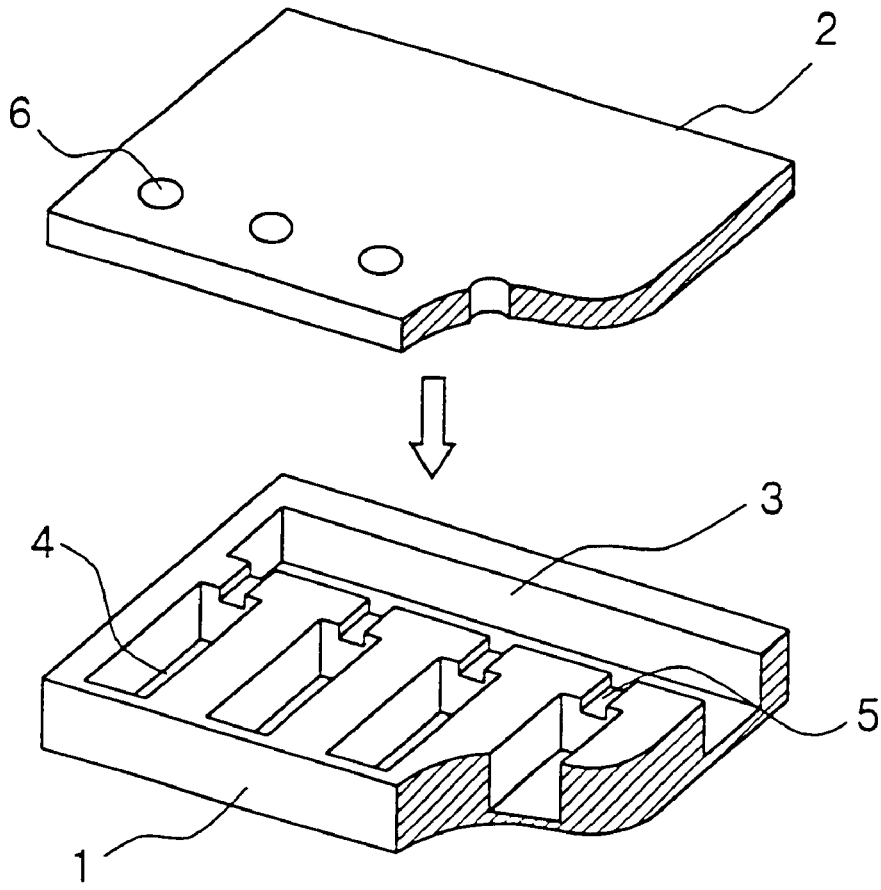
FIG. 5 is an exploded perspective view of an ink-jet recording head according to Embodiment 2 of the present invention.

FIG. 5 is an exploded perspective view of an ink-jet recording head according to Embodiment 2 of the present invention. This ink-jet recording head has a configuration in which a first plate 1 and a second plate 2 are bonded and stacked on each other so as to form an ink supply portion 3, a pressure chamber 4 for ejecting ink by vibration of a diaphragm such as an electrostatic diaphragm vibrating electrostatically, a piezoelectric diaphragm of PZT or the like, etc., or by heating of a heating unit, and a flow path 5 passed by the ejected ink. In the second plate 2, a nozzle hole 6 is formed perpendicularly to the flow path 5. In addition, the porous structure in FIG. 1 is formed on a surface of the second plate 2, and a water repellant film is formed on the surface of the second plate 2.

Figure 6:
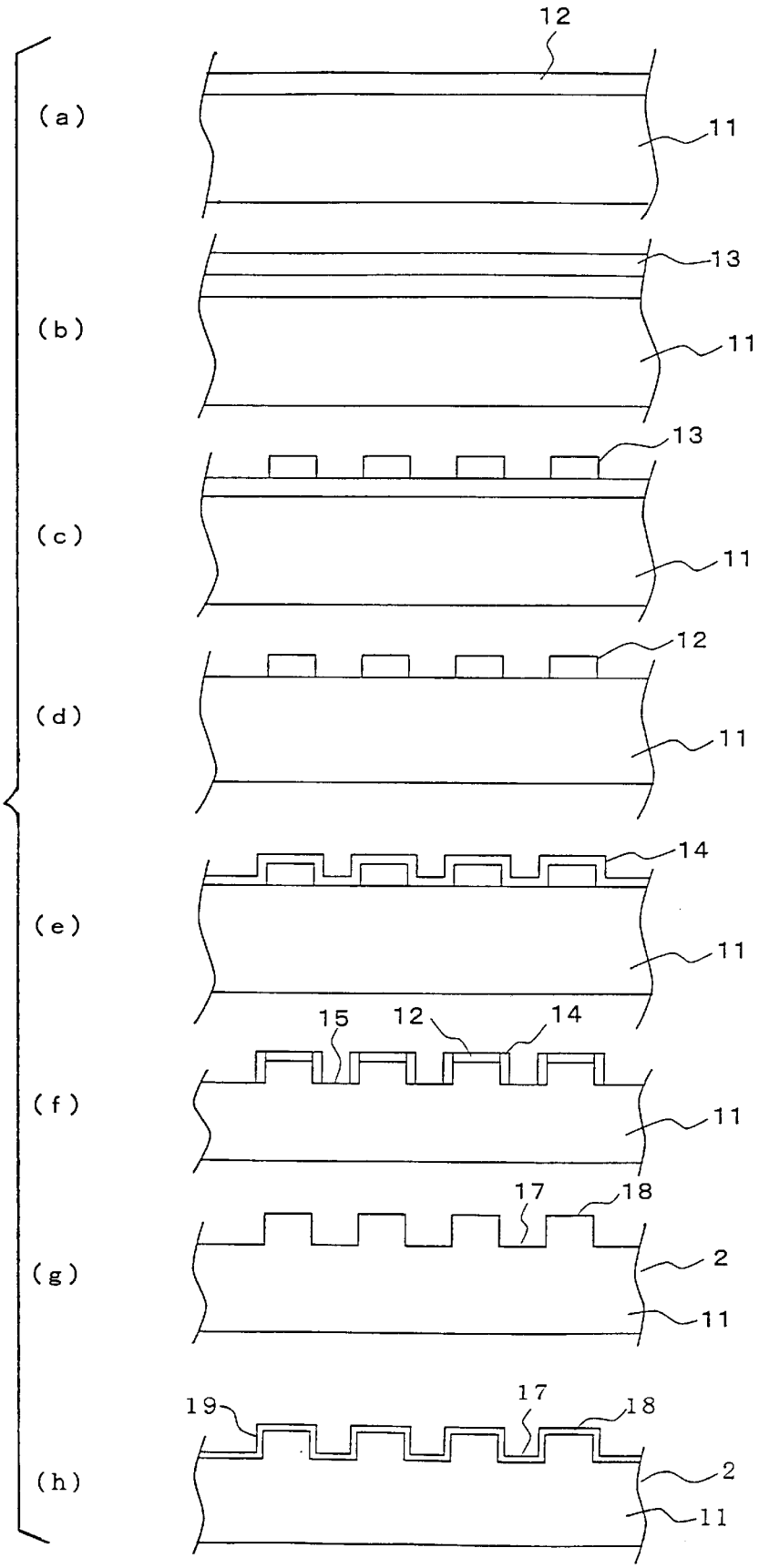
FIG. 6 is a series of sectional views showing a manufacturing process for forming a porous structure on a surface of a second plate in the Embodiment 2.
Figure 7:
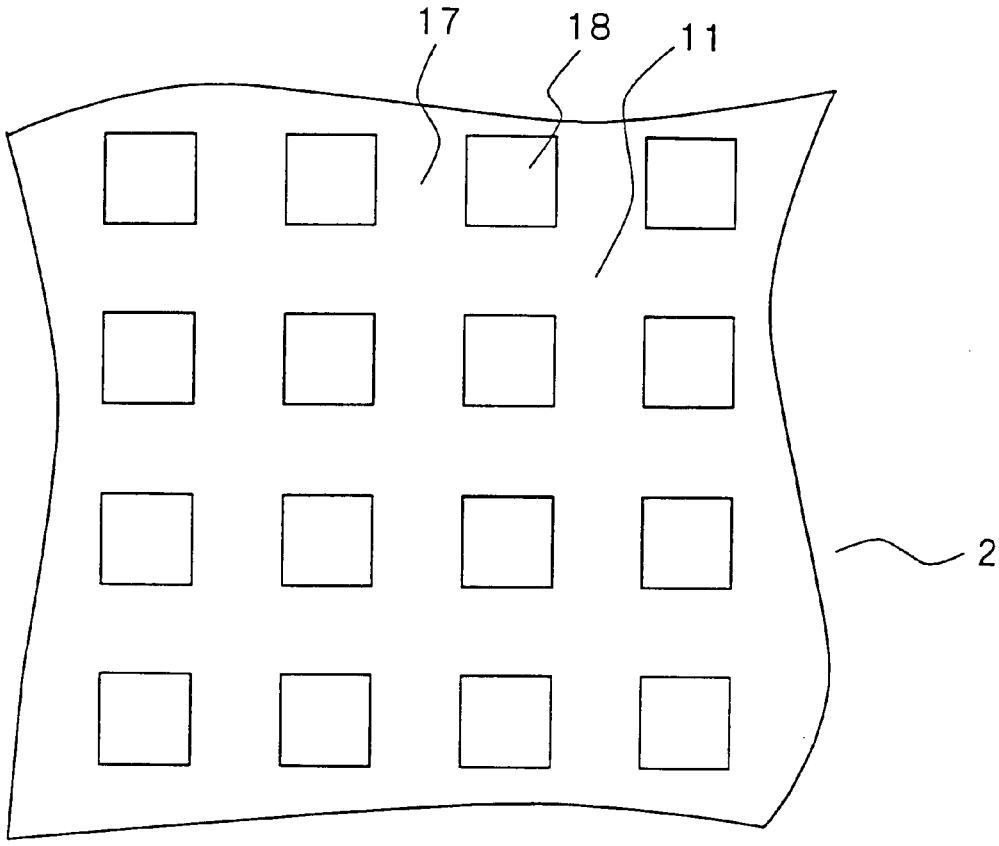
FIG. 7 is a top view of the second plate 2 having a porous structure formed on its surface.

FIG. 6 is a series of sectional views showing a manufacturing process for forming the porous structure on the surface of the second plate 2. FIG. 7 is a top view of the second plate 2 in which the porous structure is formed on the surface. The manufacturing process of the porous structure will be described with reference to FIGS. 6 and 7. Here, description will be made about the case where a porous structure is formed by working a surface of a silicon substrate by a photolithography method and a trench dry etching method.

① First, a 4-inch single-crystal silicon wafer of crystal orientation (100) is prepared as a substrate for manufacturing the second plate 2. A silicon oxide film 12 having the thickness of about 1,000 Angstroms is formed on at least one surface of the single-crystal silicon substrate 11 by a thermal oxidation method, as shown in FIG. 6(*a*).

② Next, as shown in FIG. 6(*b*), about 2 ml of photosensitive resin OFPR-800 (viscosity 30 cps) made by Tokyo Ohka Kogyo Co., Ltd. is dropped onto the silicon oxide film 12 of the single-crystal silicon substrate 11, and spin-coated thereon for 30 seconds at speed of 5,000 revolutions per minute so as to form a photosensitive resin film 13 . Under this spin-coating conditions, it is possible to coat the photosensitive resin with the average film thickness of about 1 μm with dispersion of 10% within the surface of the wafer. The film thickness is changed suitably in accordance with the size of grooves to be worked. The maximum value of the photosensitive resin film thickness is 2 μm when the width of the grooves is 2 μm.

③ Next, being dried for 30 minutes in an oven at about 90 Celsius degrees, the substrate 11 is cooled down to the room temperature. As shown in FIG. 6(*c*), the photosensitive resin film 13 is photolithographically patterned to form arranged areas for square protrusion portions each of which has sides each having a length in the range from 0.2 μm to 200 μm. Then, the photosensitive resin is cured in an oven at about 120 Celsius degrees so as to improve the resistance to etching.

④ As shown in FIG. 6(*d*), the silicon oxide film in arranged areas for recess portions is etched with fluoric acid, and the photosensitive resin is removed with release agent.

⑤ Next, a plasma synthetic film 14 is formed by a trench dry etching apparatus using gas with C and F, as shown in FIG. 6(*e*). Successively, after the dry etching apparatus is evacuated, silicon in the arranged areas 15 for recess portion is etched into grooves with plasma of gas the formula of which is $SF_6$ or $CF_4$, as shown in FIG. 6(*f*).

At this time, etching is not performed on the arranged areas for the protrusion portions because the silicon oxide film 12 exists in the areas, as shown in FIG. 6(*f*). On the other hand, anisotropic etching is effectively performed on the arranged areas for the recess portions by the effect of the plasma synthetic film formed on the portions corresponding to the side walls of the grooves. Such a plasma synthesizing step and a plasma etching step are repeated, so that the surface of the single-crystal silicon substrate 11 is etched into grooves having the depth of about 5 μm to form the recess portions 17 and the protrusion portions 18, as shown in FIG. 6(*g*). These protrusion portions 18 are laid out regularly on the surface of the single-crystal silicon substrate 11, as shown in FIG. 3.

⑥ Next, nozzle holes 6 (see FIG. 5) are worked, and fluoroalkylsilane or polyfluoroethylene water-repellant material is deposited on the single-crystal silicon substrate 11 by a vacuum deposition method so as to form a water repellant film 19 (see FIG. 1).

⑦ Finally, the first plate 1 is bonded with the thus formed second plate 2, so as to complete the ink-jet recording head.

Embodiment 3

Figure 8:
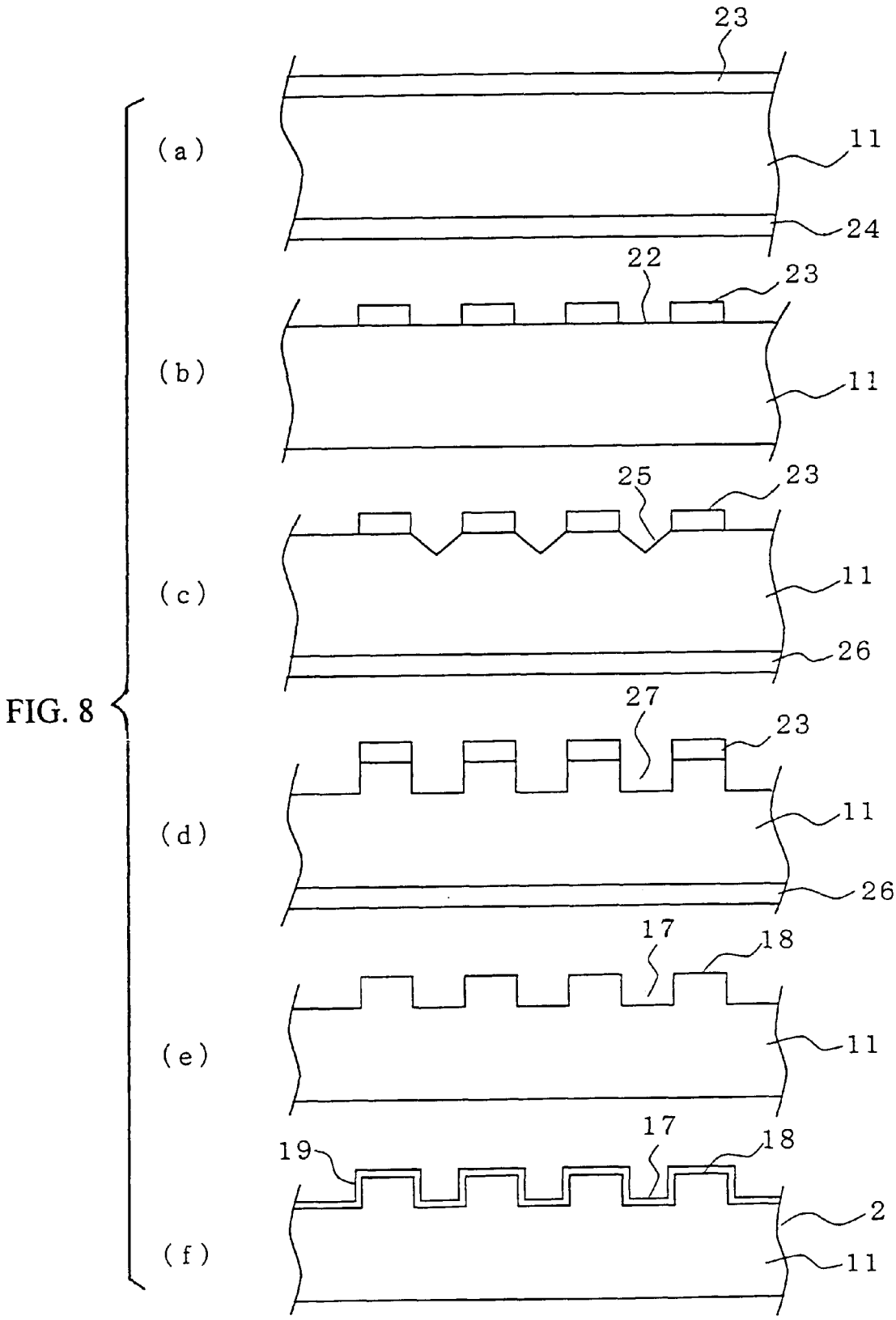
FIG. 8 is a series of sectional views showing a manufacturing process for forming a porous structure on a surface of a second plate 2 in Embodiment 3 of the present invention.

FIG. 8 is a series of sectional views showing a process showing another examples of a manufacturing process for forming a porous structure on a surface of a second plate 2. Here, description will be made about the case where a porous structure is formed by working a surface of a silicon substrate by a photolithography method and an anode electrolysis method.

① First, an n-type single-crystal silicon substrate 11 of crystal orientation (100) having the thickness of, for example, about 200 μm is prepared as a substrate for manufacturing the second plate.

② Silicon nitride films 23 and 24 having the thickness of about 0.3 μm are formed as etching resistance film on this silicon substrate 11 by a CVD apparatus, as shown in FIG. 8(*a*).

③ Next, after the silicon nitride film 24 is removed by a dry etching method, photo-etching is given to the silicon nitride film 23, so that portions 22 of the silicon nitride film 23, corresponding to the recess portions 17 of the porous structure, is etched as shown in FIG. 8(*b*).

④ Next, using the silicon nitride film 23 as mask, V-groove-shaped etching pyramids 25 are formed in the silicon substrate 11 by an anisotropic etching method with potassium hydrate water-solution. Then as shown in FIG. 8(*c*), an indium-tin oxide film (ITO film) 6 is formed on the surface opposite to the surface with the silicon nitride film 23.

⑤ Successively, an electrolytic cell is composed in a manner that the surface with the silicon nitride film 23 contacts with electrolytic solution, and light is radiated from the opposite surface, so that grooves 27 having the depth of about 5 μm are formed by etching as shown in FIG. 8(*d*). Then, the silicon nitride film and the indium-tin oxide film are removed so as to produce the recess portions 17 and the protrusion portions 18 (FIG. 8(*e*)).

⑥ Nozzle holes 6 (see FIG. 5) are worked, and fluoroalkylsilane or polyfluoroethylene water repellant material is deposited on the second plate by a vacuum deposition method, so as to form a water repellant film 19 (see FIG. 8(*f*)).

⑦ Finally, the first plate 1 is bonded with the thus formed second plate 2, so as to complete the ink-jet recording head.

Embodiment 4

Figure 9:
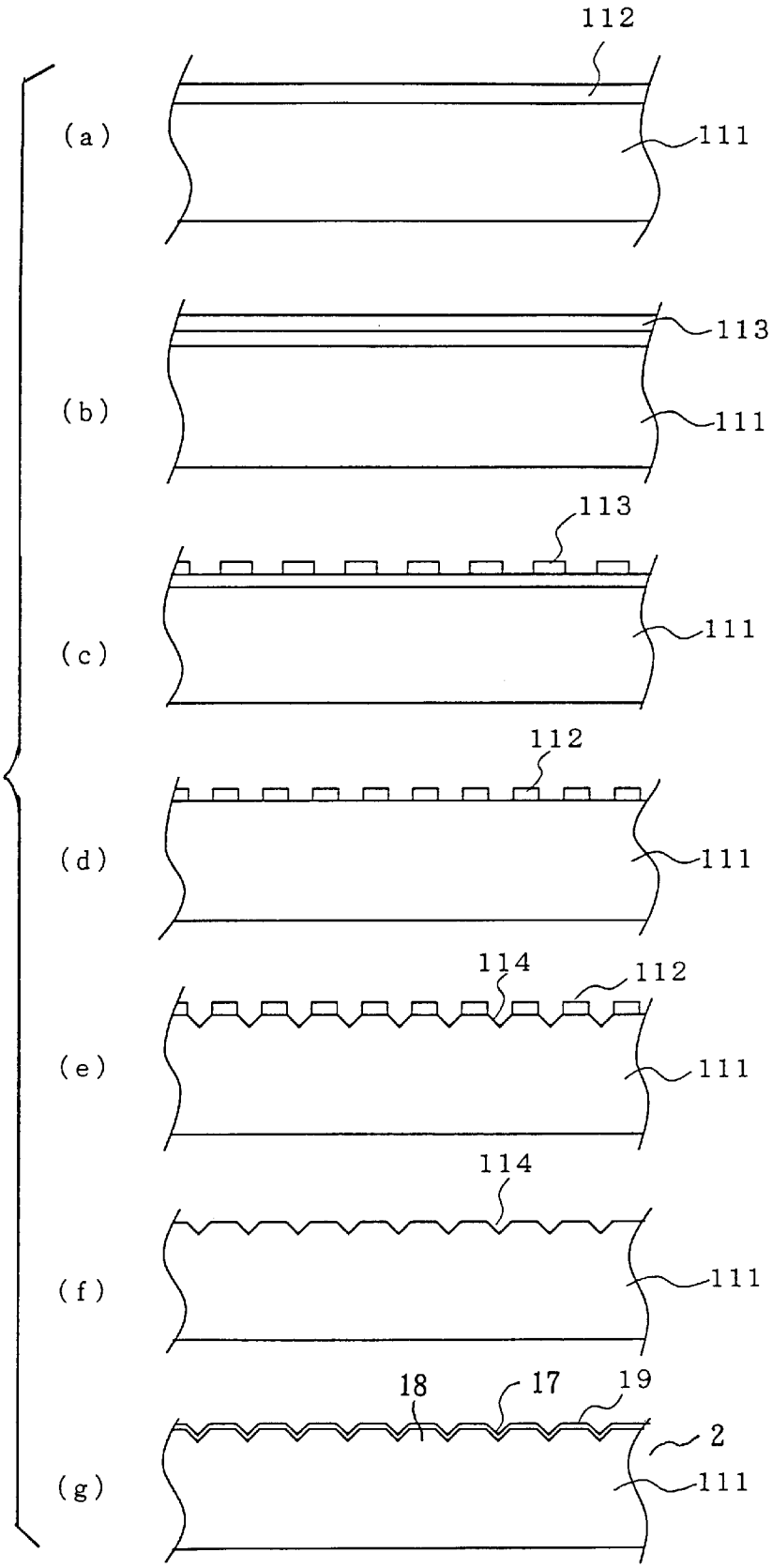
FIG. 9 is a series of sectional views showing a manufacturing process for forming a porous structure on a surface of a second plate in Embodiment 4.

FIG. 9 is a series of sectional views showing another example of a manufacturing process for forming a porous structure on a surface of a second plate. Here, description will be made about the case where a porous structure is formed by working a surface of a silicon substrate by a photolithograph method and an anisotropic wet etching method.

① First, a 4-inch single-crystal silicon wafer of crystal orientation (100) is prepared as a substrate for a plate 2. A silicon oxide film 112 having the thickness of about 1,000 Angstrom is formed on at least one surface of the single-crystal silicon substrate 111 by a thermal oxidation method, as shown in FIG. 9(*a*).

② Next, as shown in FIG. 9(*b*), about 2 ml of photosensitive resin OFPR-800 (viscosity 30 cps) made by Tokyo Okka Kogyo Co., Ltd. is dropped onto the silicon oxide film 112 of the single-crystal silicon substrate 111, and spin-coated thereon for 30 seconds at speed of 5,000 revocations per minute so as to form a photosensitive resin film 113. Under this spin-coating condition, it is possible to coat the photosensitive resin with the average film thickness of about 1 m with dispersion of 10% within the surface of the wafer. The film thickness is changed suitably in accordance with the size of grooves to be worked. The maximum value of the photosensitive resin coating film thickness is 2 μm when the width of the grooves is 2 μm.

③ Next, being dried for 30 minutes in a oven at about 90 Celsius degrees, the substrate 111 is cooled down to the room temperature. As shown in FIG. 9(*c*), the photosensitive resin film is photolithographically patterned to form arranged areas for square protrusion portions each of which has sides each having a length from 0.2 μm to 200 μm. Then, the photosensitive resin is cured in an oven at about 120 Celsius degrees so as to improve the resistance to etching.

④ As shown in FIG. 9(*d*), the silicon oxide film in arranged areas for recess portions is etched with fluoric acid, and the photosensitive resin is removed with release agent.

⑤ Next, using the silicon oxide film 112 as mask, etching pyramids 114 each having a V-shaped cross section are formed on the silicon substrate 111 as shown in FIG. 9(*e*), by an anisotropic etching method with potassium hydrate water-solution. Then, the silicon oxide film 112 is removed (FIG. 9(*f*)). The etching pyramids 114 thus formed correspond to recess portions 17 in FIG. 1. Protrusion portions 18 are naturally formed in accordance with forming of the recess portions 17 so that they are laid out regularly on the surface of the single-crystal silicon substrate 111.

⑥ Next, fluoroalkylsilane or polyfluoroethylene water-repellant material is deposited on the substrate by a vacuum deposition method so as to form a water-repellant film 19 (FIG. 9(*g*)).

Embodiment 5

Figure 10:
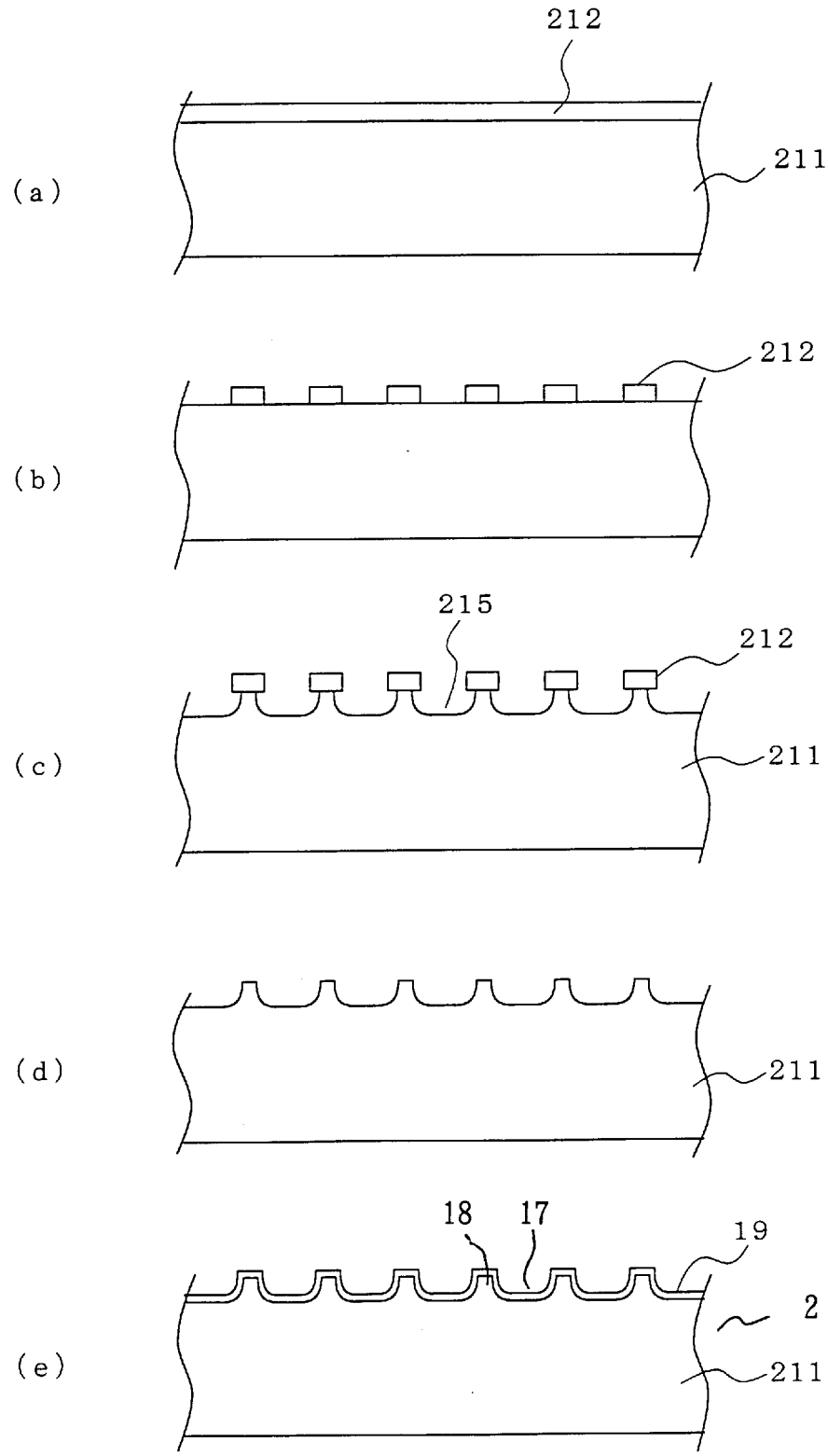
FIG. 10 is a series of sectional views showing a manufacturing process for forming a porous structure on a surface of a second plate in Embodiment 5.

FIG. 10 is a series of sectional views showing another example of a manufacturing process for forming a porous structure on a surface of a second plate 2. Here, description will be made about the case where a porous structure is formed by working a surface of a glass substrate by a photolithography method and an isotropic wet etching method.

① First, a glass substrate 211 having thickness of 200 μm, for example, is prepared as a substrate for a second plate 2.

② A silicon nitride film 212 having thickness of about 0.03 μm is formed as etching resistance film on the glass substrate 211 as shown in FIG. 10(*a*), by a spattering apparatus.

③ Next, the silicon nitride film 212 is subjected to photolithoetching to etch film portions corresponding to recess portions of the porous structure, as shown in FIG. 10(*b*).

④ Next, using the silicon nitride film 212 as mask, etched recess portions 215 are formed on the glass substrate 211 by an isotropic etching method with hydrofluoric acid water-solution, as shown in FIG. 10(*c*).

⑤ Next, the silicon nitride film is removed with heated phosphonic acid to complete the recess and protrusion portions as shown in FIG. 10(*d*).

⑥ Finally, a fluoroalkylsilane film is deposited on the glass substrate 211 by a vacuum deposition method so as to form a water-repellant film 19 (FIG. 10(*e*)).

Embodiment 6

Figure 11:
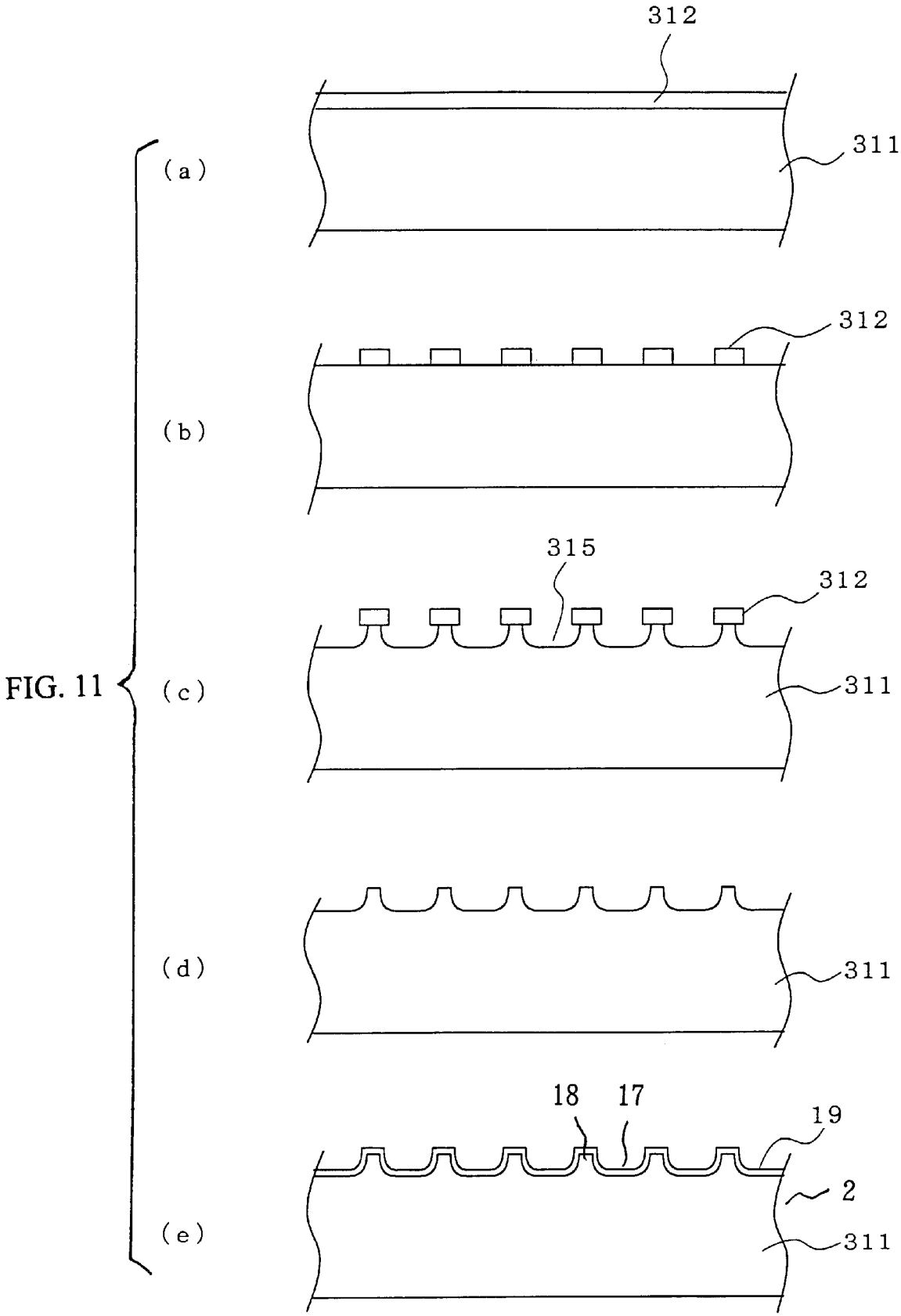
FIG. 11 is a series of sectional views showing a manufacturing process for forming a porous structure on a surface of a second plate in Embodiment 6.

FIG. 11 is a series of sectional view showing another example of a manufacturing process for forming a porous structure on a surface of a second plate 2. Here, description will be made about the case where a porous structure is formed by working a surface of a glass substrate by a photolithography method and an isotropic dry etching method.

① First, a glass substrate 311 having thickness of 200 μm, for example, is prepared as a substrate for a second plate 2.

② A photosensitive resin film 312 having thickness of about 5 μm is formed as etching resistance film on the glass substrate 311 as shown in FIG. 11(*a*), by a spin coating apparatus.

③ Next, the photosensitive resin film 312 is subjected to photolithoetching to etch film portions corresponding to recess portions of the porous structure, as shown in FIG. 11(*b*).

④ Next, using the photosensitive resin film 312 as mask, etched recess portions are formed on the glass substrate 11 by an isotropic plasma etching method with $CF_4$ gas, as shown in FIG. 11(*c*).

⑤ Next, the photosensitive resin film is removed with heated phosphonic acid to complete the recess and protrusion portions as shown in FIG. 11 (*d*).

⑥ Finally, a fluoroalkylsilane film is deposited on the glass substrate 311 by a vacuum deposition method so as to form a water-repellant film 19 (FIG. 11(*e*)).

It was confirmed that the porous structures (water repellant structures) formed in the above Embodiment 3 to 6 had uniform heights (less dispersion in heights) of the protrusion portions, and as a result, provided the same water repellency function, durability and scratch proof function as the porous structure in Embodiment 2.

Incidentally, as any porous structure (water repellant structures) in the above Embodiments 2 to 6 is formed by using photolithography method and an etching method, uniform depths of the recess portions, that is uniform heights of protrusion portions, can be obtained. Further, a surface of a substrate is shifted to top surfaces of protrusion portions so that the top surfaces can naturally be placed on an even surface with accuracy.

Embodiment 7

Although the above-mentioned embodiments have been described about the case where a silicon substrate or a glass substrate is used as material of the second plate 2, the material of the second plate 2 is not limited to those materials, but metal material such as stainless steel or organic polymer material may be used in the present invention, presenting the same function.

Embodiment 8

It was confirmed that high-quality printing could be obtained when printing was performed by an ink-jet recording apparatus mounted with an ink-jet recording head according to either of the above-mentioned Embodiments 2 and 3. Particularly, it was confirmed that the ink-jet recording apparatus had wear resistance against rubbing in cleaning because the water repellant function was produced by a recess/protrusion mechanism so that the apparatus could endure long-term use.

Embodiment 9

In addition, a porous structure according to the present invention is superior in water repellency, and therefore effective also as, for example, a waterproof/anti-contamination structure in electronic equipments.

EXAMPLE 1

As Example 1 of the present invention, samples of second plates (as seen in FIG. 5) manufactured in the above Embodiments were prepared as shown in Table 1. First, substrate materials for samples 1 to 7 of second plates shown in Table 1 were prepared. Square protrusion portions having a size from 0.2 $\mu$m to 1,000 $\mu$m were formed on a surface of each substrate material (see FIG. 4). In addition, a water repellant film was formed on the surface by deposition of fluoroalkylsilane or polyfluoroethylene water-repellant material. This water repellency treatment was not performed on the samples 2, 4 and 6.

TABLE 1

| | Substrate Material | Protrusion size (micron square) | Water repellency treatment |
|---|---|---|---|
| Sample 1 | Silicon | 0.2 | given |
| Sample 2 | Silicon | 0.2 | not-given |
| Sample 3 | Glass | 5 | given |
| Sample 4 | Quartz Glass | 5 | not-given |
| Sample 5 | Quartz Glass | 10 | given |
| Sample 6 | Silicon | 10 | not-given |
| Sample 7 | Glass | 500 | given |

(COMPARATIVE EXAMPLE 1)

Figure 12:
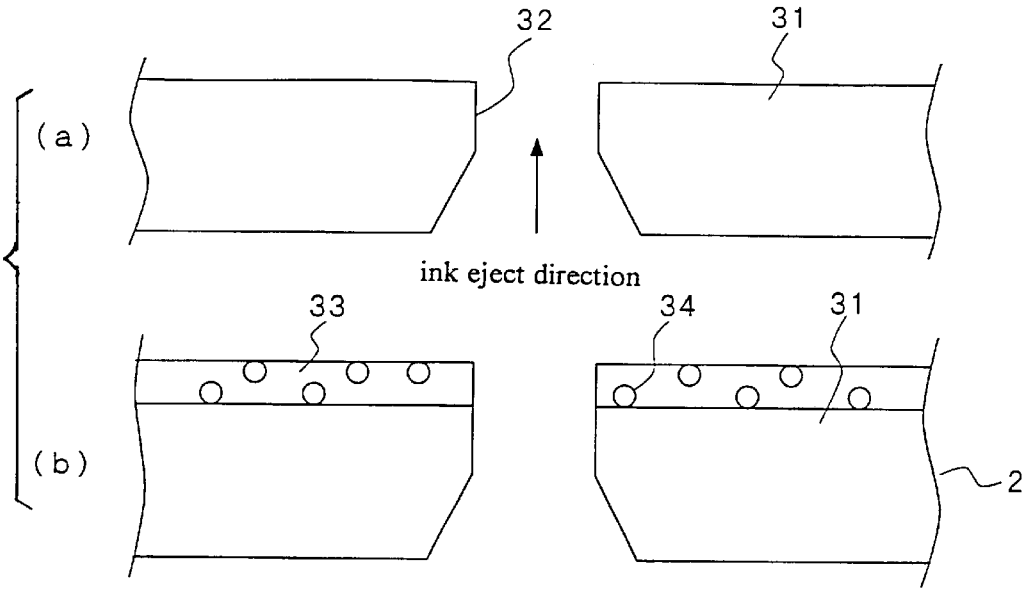
FIG. 12 is a series of sectional views showing a manufacturing process of a second plate in Comparative Example 1.

FIG. 12 is a series of sectional views showing a manufacturing process of a second plate as shown in FIG. 5, in this Comparative Example 1 where water repellent material is applied onto a second plate of stainless steel.

① First, as shown in FIG. 12(*a*), a substrate 31 for the second plate is worked to form nozzle holes 32, and then ultrasonically cleaned with alkaline solvent.

② The substrate 31 is immersed in nickel plating electrolytic solution including polyfluoroethylene particles increased in fluorine atom density. An eutectoid plated film 33 in which polyfluoroethylene particles 34 increased in fluorine atom density are dispersed is produced on a surface of the substrate 31 by electro-plating, as shown in FIG. 12(*b*). This plated film 33 contains the polyfluoroethylene particles 34 increased in fluorine atom density.

(COMPARATIVE EXAMPLE 2)

Figure 13:
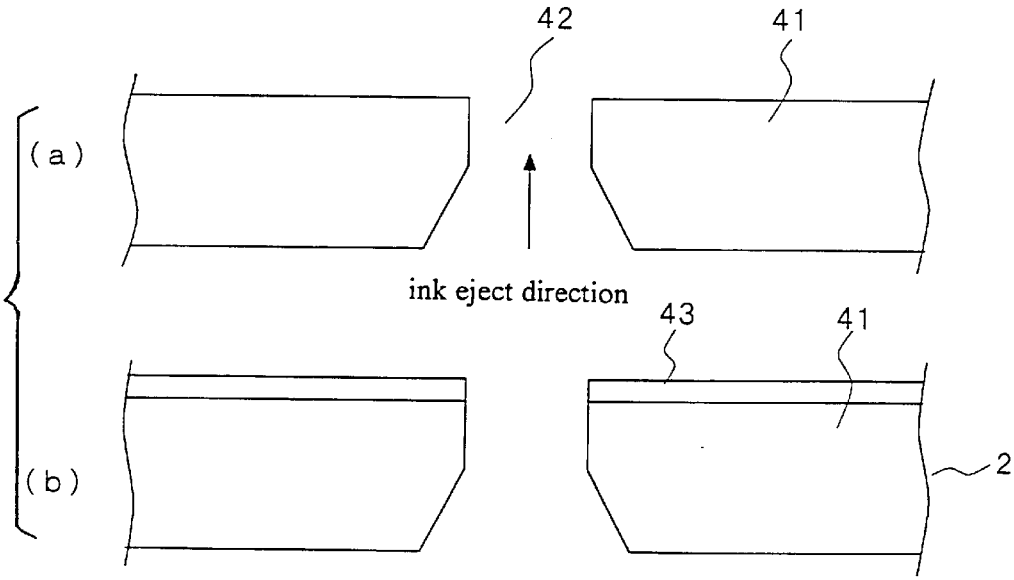
FIG. 13 is a series of sectional views showing a manufacturing process of a second plate in Comparative Example 2.

FIG. 13 is a series of sectional views showing a manufacturing process of a second plate as shown in FIG. 5, in this Comparative Example 2 where water repellent material is applied onto a second plate of polysulfonate.

① First, as shown in FIG. 13(*a*), a substrate 41 for the second plate is worked to form nozzle holes 42, and then ultrasonically cleaned with alkaline solvent.

② Successively, tradename "Kanpenirex" made by KANSAI PAINT CO., LTD. is coated on a surface of the substrate 41 so as to produce a coating film 43, as shown in FIG. 13(*b*).

Table 2 shows the results of measuring the contact angle of the surfaces of the second plates prepared in the above-mentioned Example 1, and Comparative Examples 1 and 2, to water and ink respectively.

TABLE 2

| | Water contact angle (degree) | Ink contact Angle (degree) |
|---|---|---|
| Example 1 | | |
| sample 1 | 160 | 130 |
| sample 2 | 150 | 110 |
| sample 3 | 160 | 125 |
| sample 4 | 140 | 115 |
| sample 5 | 150 | 120 |
| sample 6 | 145 | 90 |
| sample 7 | 140 | 110 |
| Comparative Example 1 | 130 | 60 |
| Comparative Example 2 | 160 | 120 |

As shown in the above Table 2, the contact angle of the second plate in each sample of this Example 1 was larger than 120 degrees in the case to water and larger than 90 degrees in the case to ink. Each sample in the Example 1 takes higher values of the contact angle than those in Comparative Example 1.

Each of the second plates according to samples 1 to 7 in Example 1 and Comparative Examples 1 and 2 was bonded a first plate as shown in FIG. 5 to form an ink-jet recording head and it was mounted on a recording apparatus. Printing text was given on the apparatus including respective second plate, under initial condition and accelerating conditions corresponding to two years. Then, the results shown in Table 3 were obtained. Table 3 shows the results of judgement of printing quality, where the mark ⊙ designates a superior result in which printing quality is good and no ink mist adheres to the surface of the second plate, the mark ○ designates a good result in which printing quantity is good but ink mist adheres to the surface of the second plate, and the mark × designates a inferior result with defective printing quantity caused by bending of ink flight.

TABLE 3

| | Initial | After accelerating printing test Corresponding to two years |
|---|---|---|
| Example 1 | | |
| sample 1 | ◎ | ◎ |
| sample 2 | ◎ | ○ |
| sample 3 | ◎ | ◎ |
| sample 4 | ◎ | ○ |
| sample 5 | ◎ | ◎ |
| sample 6 | ◎ | ○ |
| sample 7 | ◎ | ◎ |
| Comparative Example 1 | ○ | x |
| Comparative Example 2 | ◎ | x |

TABLE 4

| | Water Repellency | | | | | | |
|---|---|---|---|---|---|---|---|
| | Structural size (actual survey) | | | | | Initial Performance | |
| No. | Structure | protrusion width A(μm) | Recess width B(μm) | Working quantity C(μm) | side wall angle D(°) | Purified water (°) | HQ284C ink (°) |
| 1 | Square pole | 0.2 | 24 | 3.2 | 14 | 140 | 98 |
| 2 | square pole | 1.0 | 6.0 | 6.8 | 1 | 158 | 102 |
| 3 | in lines | 1.2 | 2.0 | 7.8 | 1 | 138 | 122 |
| 4 | square pole | 1.5 | 2.5 | 3.6 | 3 | 140 | 113 |
| 5 | square pole | 3.4 | 3.8 | 5.0 | 12 | 140 | 128 |
| 6 | square pole | 4.0 | 6.0 | 8.6 | 0 | 150 | 106 |
| 7 | in lines | 4.0 | 6.0 | 8.0 | 4 | 131 | 107 |
| 8 | square pole | 5.2 | 4.8 | 2.8 | 4 | 149 | 105 |
| 9 | square pole | 6.0 | 4.0 | 3.2 | 18 | 158 | 107 |
| 10 | lat-tice | 4.3 | 6.0 | 10.0 | 2 | 123 | 92 |
| Comparative Example; water repellency treatment on mirror surface | | | | | | 115 | 70 |

As described above, the ink-jet recording heads using the second plate in this Example 1 were superior in printing quality under the initial conditions and the accelerating conditions corresponding to two years. The reproducibility of the superior printing quality was also confirmed. Among the second plates in Example 1 having square protrusion portions of a size within a range from 0.2 μm to 500 μm, the plates having a water repellant film formed by coating water repellant agent exhibited the best printing quality. However, in the ink-jet recording heads using the second plates according to Comparative Examples 1 and 2, the water repellency and printing quantity deteriorated under the accelerating conditions corresponding to two years because ink adhered to the surface of the second plates.

EXAMPLE 2

In Example 2 of the present invention, contact angles of surfaces having porous structures with the respective shapes of protrusion portions formed into square poles, in lines and in a lattice (see FIGS. 4A, 4B and 4C) were examined to water and ink. Table 4 shows data of the examination. In each sample according to the present invention (No. 1 to No. 10), the contact angle was not smaller than 120 degrees in the case of water, and not smaller than 90 degrees in the case of ink. It was understood that the water repellency function was obtained. In Comparative Example in Table 4, a water repellant film was formed on a mirror-polished surface (corresponding to the prior art). This example did not satisfy necessary conditions for obtaining the water repellency function.

EXAMPLE 3

Molding was performed by using, for example, resin as a raw material and using a porous struture of Example 1 or 2 (water repellency treatment is not necessarily required) as a mold. Molded products thus obtained had an rugged pattern on the surface which had been transferred from the rugged pattern of the mold. It was confirmed that the porous structures of the molded product with or without water repellency treatment had superior characteristics similar to Examples 1 and 2.

What is claimed is:

1. A porous structure comprising a substrate having a surface having protrusion portions and recess portions between said protrusion portions and a water repellent film formed over said substrate, wherein said protrusion and recess portions have such a size that liquid drops that come into contact with said surface do not fall down into said recess portions and contact the bottoms of the recess portions, thereby defining an air layer between each of the drops and the bottom of each of the recess portions, so as to give water repellency to said surface.

2. A porous structure according to claim 1, characterized in that widths of the protrusion portions or the recess portions are between 0.2 μm and 500 μm.

3. A porous structure according to claim 1, characterized in that widths of the protrusion portions or the recess portions are between 0.5 $\mu$m and 30 $\mu$m.

4. A porous structure according to claim 1, characterized in that widths of the protrusion portions or the recess portions are between 1 $\mu$m and 10 $\mu$m.

5. A porous structure according to claim 1, characterized in that a water repellant film is formed on said substrate having said protrusion and recess portions.

6. A porous structure according to claim 1, characterized in that said protrusion portions are distributively disposed, or disposed in the form of stripes or a lattice.

7. A porous structure according to claim 1, characterized in that said substrate is of silicon, silicon oxide, or glass.

8. An ink jet recording head comprising a first plate and a second plates provided with nozzle holes for ejecting ink drops, said first and second plates being bonded, wherein said second plate is constituted by a substrate on which protrusion portions, recess portions between said protrusion portions, and a water repellent film are formed, said protrusion and recess portions have such size that said ink drops which come into contact with said surface do not fall down into said recess portions and contact the bottoms of the recess portions, thereby defining an air layer between each of the drops and the bottom of each of the recess portions, so as to give water repellency to said surface.

9. An ink-jet recording apparatus equipped with the ink-jet recording head defined in claim 8.

10. An ink-jet recording head according to claim 8, and further comprising:

a water repellent film on said protrusion and recess portions.

11. An ink-jet recording apparatus equipped with the ink-jet recording head defined in claim 10.

* * * * *